US009132641B2

(12) United States Patent
Shimizu

(10) Patent No.: US 9,132,641 B2
(45) Date of Patent: Sep. 15, 2015

(54) LIQUID EJECTING APPARATUS AND METHOD OF CLEANING HEAD

(71) Applicant: SEIKO EPSON CORPORATION, Tokyo (JP)

(72) Inventor: Kazutoshi Shimizu, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,276

(22) Filed: Mar. 24, 2014

(65) Prior Publication Data

US 2014/0292918 A1 Oct. 2, 2014

(30) Foreign Application Priority Data

Mar. 29, 2013 (JP) ..... 2013-071595

(51) Int. Cl.
*B41J 2/165* (2006.01)

(52) U.S. Cl.
CPC ..... *B41J 2/16535* (2013.01); *B41J 2/16544* (2013.01); *B41J 2/16552* (2013.01); *B41J 2/16585* (2013.01); *B41J 2002/16558* (2013.01)

(58) Field of Classification Search
CPC ..... B41J 2/16538
USPC ..... 347/33
See application file for complete search history.

(56) References Cited

U.S. PATENT DOCUMENTS

| | | | | |
|---|---|---|---|---|
| 5,432,539 | A * | 7/1995 | Anderson | 347/33 |
| 6,530,643 | B1 * | 3/2003 | Askren et al. | 347/33 |
| 2001/0012027 | A1 * | 8/2001 | Murcia et al. | 347/22 |

FOREIGN PATENT DOCUMENTS

| | | |
|---|---|---|
| JP | 2009-172981 | 8/2009 |

* cited by examiner

*Primary Examiner* — Stephen Meier
*Assistant Examiner* — Alexander D Shenderov
(74) *Attorney, Agent, or Firm* — Workman Nydegger

(57) ABSTRACT

A liquid ejecting apparatus includes a head in which a nozzle ejecting liquid onto a recording medium is provided; a first wiping member which performs a first wiping process of wiping off foreign materials adhered to a nozzle opening surface of the head by moving a relative position thereof with respect to the head to the other side from one side in a predetermined direction, in a state of being in contact with the nozzle opening surface; and a second wiping member which performs a second wiping process of removing the foreign materials adhered to a side surface of the head at the other side in the predetermined direction.

6 Claims, 11 Drawing Sheets

LIQUID EJECTING APPARATUS AND METHOD OF CLEANING HEAD

BACKGROUND

1. Technical Field

The present invention relates to a liquid ejecting apparatus and a method of cleaning a head.

2. Related Art

As an example of a liquid ejecting apparatus, an ink jet printer (hereinafter, referred to as printer) which ejects ink (liquid) toward a recording medium from a nozzle provided in a head is known. Since foreign materials such as ink or paper dust adhere to a nozzle opening surface of the head, a wiping process of wiping off the foreign materials from the nozzle opening surface using a wiper is regularly performed in the printer. However, there are problems that the foreign materials such as the ink gathered up by the wiper are easily accumulated on a side surface of the head positioned at a wiping-end position of the wiper and the recording medium is contaminated by the accumulated foreign materials. Accordingly, a printer has been proposed in which an absorbent member absorbing the ink or the like is provided on the side surface of the head positioned at the wiping-end position of the wiper (refer to JP-A-2009-172981).

However, although the absorbent member is provided on the side surface of the head as in JP-A-2009-172981, if the absorbent member can not completely absorb the ink anymore, the ink is dropped out from the absorbent member, and thereby the recording medium is contaminated. Also, problems occur in which time, labor, and cost are incurred in order to replace the absorbent member which can not completely absorb the ink anymore.

SUMMARY

An advantage of some aspects of the invention is that contamination of a recording medium occurring by foreign materials adhered to a head is suppressed.

According to an aspect of the invention, there is provided a liquid ejecting apparatus that includes a head in which a nozzle ejecting liquid onto a recording medium is provided; a first wiping member which performs a first wiping process of wiping off foreign materials adhered to a nozzle opening surface of the head by moving a relative position thereof with respect to the head to the other side from one side in a predetermined direction, in a state of being in contact with the nozzle opening surface; and a second wiping member which performs a second wiping process of removing the foreign materials adhered to a side surface of the head at the other side in the predetermined direction.

Other Characteristics of the invention will become apparent by descriptions of the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Summary of Disclosure

Figure 1A:
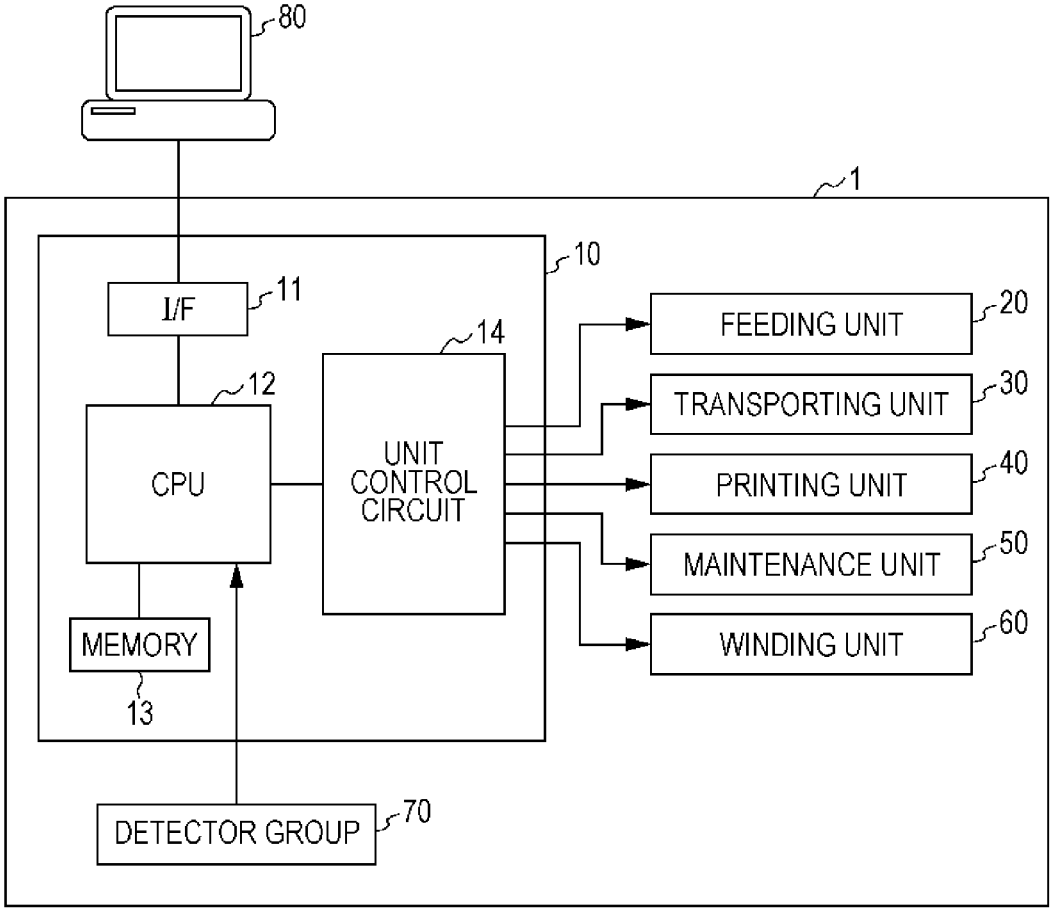
FIG. 1A is a block diagram illustrating a whole configuration of a printing system.

By a description of the present specification and a description of the accompanying drawings, at least the following will become apparent.

According to an aspect of the invention, there is provided a liquid ejecting apparatus including: a head in which a nozzle ejecting liquid onto a recording medium is provided; a first wiping member which performs a first wiping process of wiping off foreign materials adhered to a nozzle opening surface of the head by moving a relative position thereof with respect to the head to the other side from one side in a predetermined direction, in a state of being in contact with the nozzle opening surface; and a second wiping member which performs a second wiping process of removing the foreign materials adhered to a side surface of the head at the other side in the predetermined direction.

According to such a liquid ejecting apparatus, even when the foreign materials gathered up by the first wiping member adhere to the side surface of the head, it is possible to remove the foreign materials using the second wiping member. Thus, it is possible to suppress contamination of the recording medium caused by the foreign materials adhered to the head.

In the liquid ejecting apparatus, the second wiping member may be arranged at a position for contacting the foreign materials adhered to the side surface of the head without contacting the side surface, at the time of the second wiping process.

According to such a liquid ejecting apparatus, it is possible to remove the foreign materials adhered to the side surface of the head using the second wiping member, and improve durability of the second wiping member.

In the liquid ejecting apparatus, the second wiping member and the head may perform a relative movement in a direction crossing the predetermined direction, at the time of the second wiping process.

According to such a liquid ejecting apparatus, it is possible to remove the foreign materials by wiping the side surface of the head in the direction crossing the predetermined direction.

In the liquid ejecting apparatus, a groove which leads the foreign materials adhered to the side surface of the head to an exhausting portion may be provided in a surface of the second wiping member at a side opposing the head.

According to such a liquid ejecting apparatus, for example, even in a case where the second wiping member does not directly contact the side surface of the head, it is possible to more reliably remove the foreign materials (liquid) from the side surface of the head, using a capillary force of the groove provided in the second wiping member.

In the liquid ejecting apparatus, the second wiping member may have a brush shape.

According to such a liquid ejecting apparatus, even in a case where the second wiping member does not directly contact the side surface of the head, it is possible to more reliably remove the foreign materials (liquid) from the side surface of the head, using a capillary force of a brush portion of the second wiping member.

The liquid ejecting apparatus may further include a third wiping member which wipes off the foreign materials adhered to an end portion of the nozzle opening surface of the head at the other side in the predetermined direction by performing a relative movement to the head in a direction crossing the predetermined direction, in a state of being in contact with the end portion.

According to such a liquid ejecting apparatus, it is possible to make the nozzle opening surface of the head cleaner, and to suppress the contamination of the recording medium caused by the foreign materials adhered to the head.

According to another aspect of the invention, there is provided a method of cleaning a head in which a nozzle ejecting liquid onto a recording medium is provided, including: performing a first wiping process of wiping off foreign materials adhered to a nozzle opening surface of the head by moving a relative position of a first wiping member with respect to the head to the other side from one side in a predetermined direction, with the first wiping member being in contact with the nozzle opening surface; and performing a second wiping process of removing the foreign materials adhered to a side surface of the head at the other side in the predetermined direction.

According to such a method of cleaning the head, even when the foreign materials gathered up by the first wiping member adhere to the side surface of the head, it is possible to remove the foreign materials using the second wiping member. Thus, it is possible to suppress contamination of the recording medium caused by the foreign materials adhered to the head.

Printing System

Hereinafter, embodiments will be described using an example of a printing system in which a liquid ejecting apparatus is defined as an ink jet printer (hereinafter, referred to as printer) and a computer is connected to the printer.

Figure 1B:
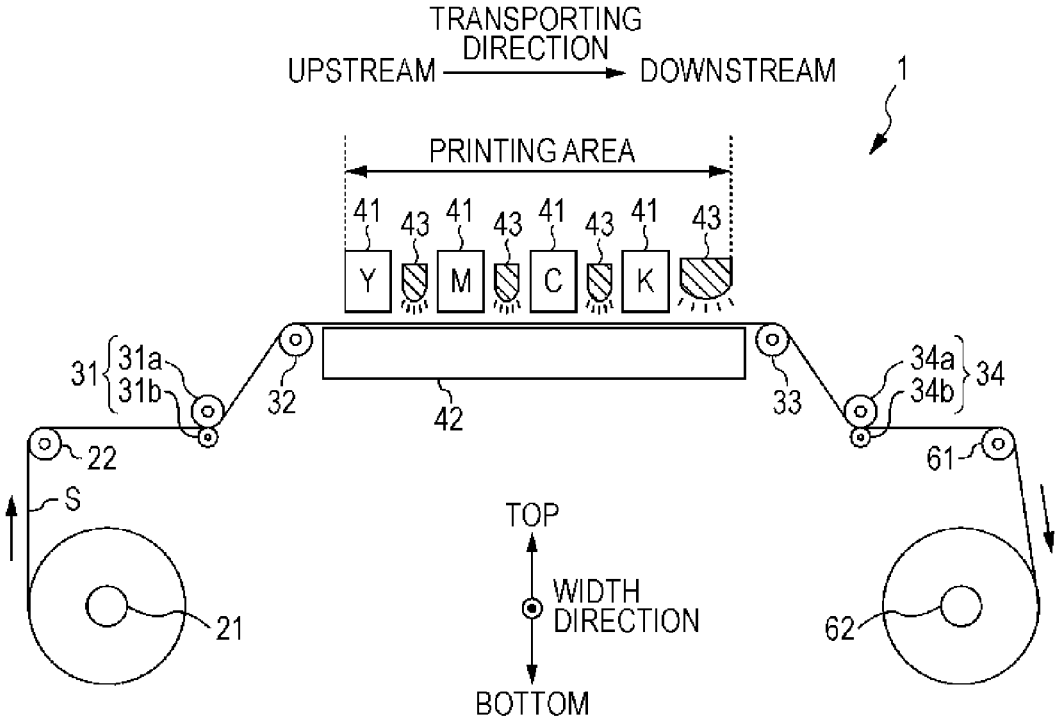
FIG. 1B is a schematic sectional view of a printer.
Figure 2:
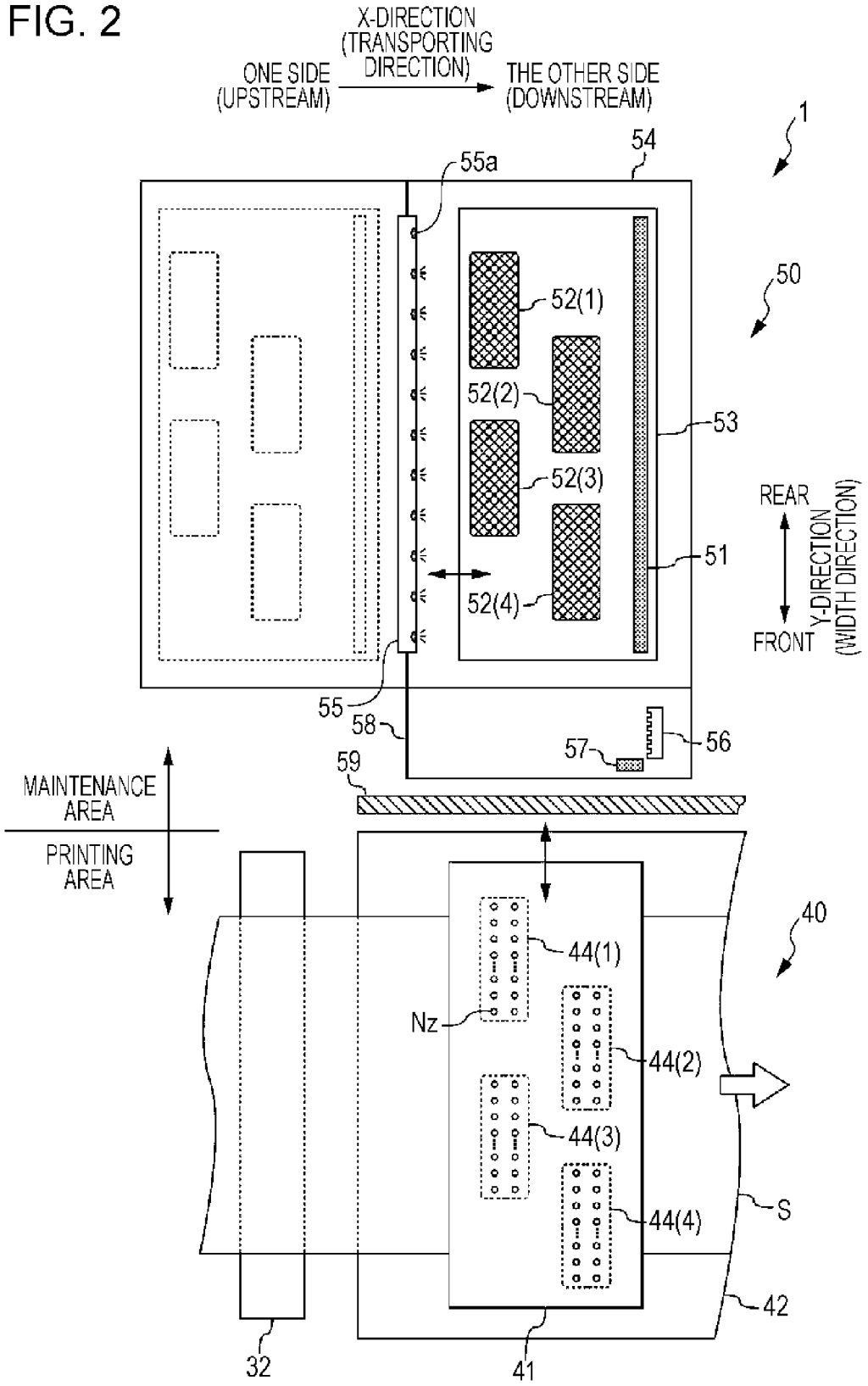
FIG. 2 is a schematic top view of the printer.
Figure 3A:
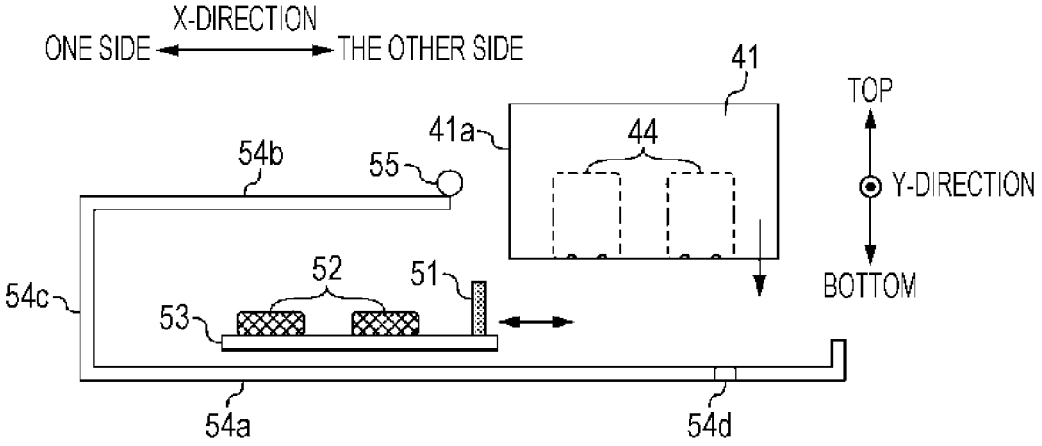
FIG. 3A is a schematic sectional view of a vicinity of a main wiper.
Figure 3B:
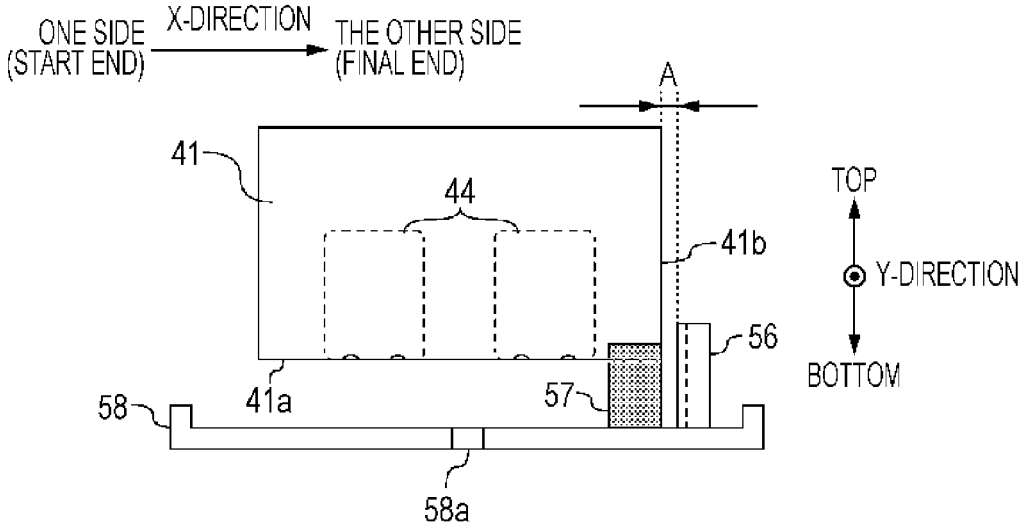
FIG. 3B is a schematic sectional view of a vicinity of a side wiper.
Figure 3C:
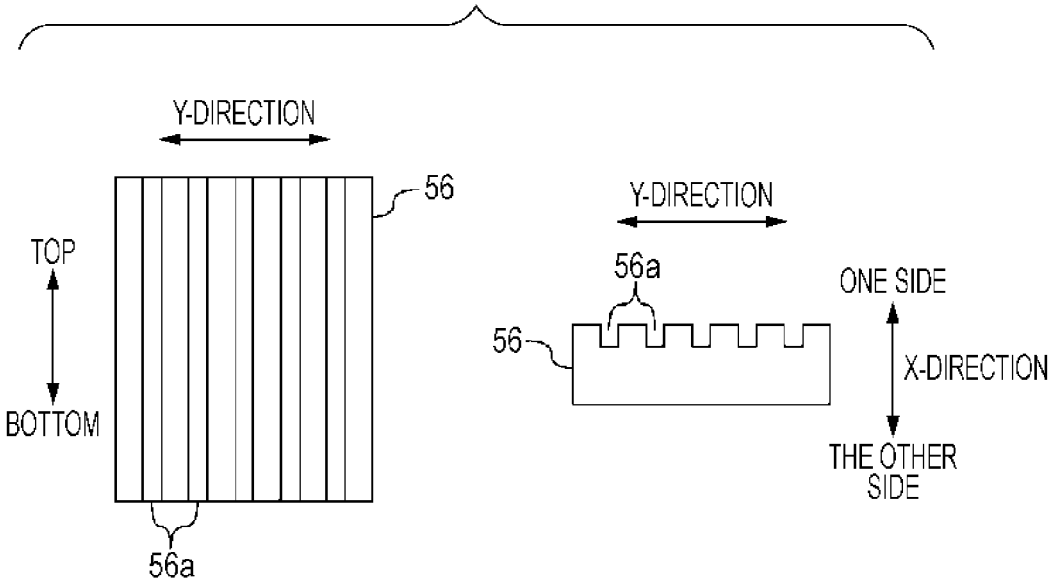
FIG. 3C is a view for explaining the side wiper.

FIG. 1A is a block diagram illustrating a whole configuration of a printing system, and FIG. 1B is a schematic sectional view of a printer 1. FIG. 2 is a schematic top view of the printer 1. FIG. 3A is a schematic sectional view of a vicinity of a main wiper 51, when viewed from an Y-direction. FIG. 3B is a schematic sectional view of a vicinity of a side wiper 56, when viewed from the Y-direction. FIG. 3C is a view for explaining the side wiper 56. In addition, a left view of FIG. 3C is a plan view of the side wiper 56, when viewed from one side in an X-direction, and a right view of FIG. 3C is a sectional view of the side wiper 56 cut along a direction orthogonal to a vertical direction. The printer 1 and a computer 80 are connected so as to be able to communicate with each other, and a printer driver installed in the computer 80 produces printing data for causing the printer 1 to print an image and outputs the data to the printer 1. The printer 1 includes a controller 10, a feeding unit 20, a transporting unit 30, a printing unit 40, a maintenance unit 50, a winding unit 60, and a detector group 70.

The controller 10 in the printer 1 performs an overall control of the printer 1. An interface portion 11 performs data transmission and reception with the computer 80 provided as an external apparatus or an internal apparatus. A CPU 12 is an arithmetic processing unit for performing an overall control of the printer 1, and controls each unit via a unit control circuit 14. A memory 13 is used to secure an area for storing a program, a work area, or the like of the CPU 12. A situation within the printer 1 is monitored by the detector group 70, and the controller 10 performs the control based on a detection result from the detector group 70.

The feeding unit 20 includes a feeding shaft 21 which rotatably supports continuing paper (hereinafter, referred to as continuous paper) wound in a roll shape and feeds out the continuous paper S by rotating, and a relay roller 22 which winds the continuous paper S fed out from the feeding shaft 21 and leads the continuous paper S to an upstream transport roller pair 31. In addition, a recording medium on which the printer 1 prints an image is not limited to the continuous paper S, and may be cut paper, fabric, felt or the like.

The transporting unit 30 includes a plurality of relay rollers 32 and 33 which wind and feed out the continuous paper S, the upstream transport roller pair 31 which is arranged at an upstream side in a transport direction rather than a printing area, and downstream transport roller pair 34 which is arranged at a downstream side in the transport direction rather than the printing area. The upstream transport roller pair 31 and the downstream transport roller pair 34 include driving rollers 31*a* and 34*a* which rotate by motors (not illustrated) connected thereto, and driven rollers 31*b* and 34*b* which rotate according to the rotation of the driving rollers, respectively. Then, each of the upstream transport roller pair 31 and the downstream transport roller pair 34 pinch the continuous paper S, and in this state, the driving rollers 31*a* and 34*a* rotate, and thereby a transport force is applied to the continuous paper S.

The printing unit 40 include heads 41 provided for each ink color, a platen 42 which supports an opposite side surface with respect to a printing surface of the continuous paper S in the printing area, and an irradiation unit 43 which irradiates ultraviolet rays. The printer 1 according to the present embodiment can eject four color inks of yellow (Y), magenta (M), cyan (C), and black (K), and as illustrated in FIG. 1B, four heads 41 are lined up in the transport direction. In addition, each head 41 is configured so as to be able to move in a width direction (Y-direction) crossing the transport direction of the continuous paper, and in the vertical direction. In addition, in the present embodiment, ultraviolet curing type ink (UV ink) which cures by being irradiated with the ultraviolet rays is used. For this reason, irradiation units 43 are provided at downstream sides of the heads 41. In addition, by the irradiation units 43 between the heads 41, the UV ink may be temporarily cured and thereby bleeding and peeling between the different colored inks may be suppressed, and the UV ink may be fully cured by the irradiation unit 43 at the side furthest downstream. In addition, the ink used by the printer 1 is not limited to the UV ink, and for example, may be any other ink such as water-based dye ink.

In each head 41, as illustrated in FIG. 2, a plurality of short heads 44(1) to 44(4) is lined up in the Y-direction (width direction of the continuous paper S). In an opposite surface (lower surface) with respect to the continuous paper S in each short head 44, multiple nozzles Nz which eject the inks are lined up at each predetermined interval in the Y-direction. In FIG. 2, when the head 41 is viewed from above, the short heads 44 and positions of the nozzles Nz are virtually illustrated. In addition, a portion of the positions of end portion nozzles Nz of the short heads 44 lined up in the Y-direction are overlapped each other, and at the lower surface of the head 41, the nozzles Nz are lined up at predetermined interval in the Y-direction over the continuous paper S with distance between both end nozzles equal to or greater than the width of the continuous paper S. Thus, the ink is ejected from the nozzles Nz with respect to the continuous paper S being transported without stopping at the bottoms of the heads 41, and thereby a two-dimensional image is printed on the continuous paper S. In addition, for example, a method of ejecting the ink from the nozzles Nz may be a piezo method of ejecting the ink by expanding or contracting an ink chamber by applying a voltage to a piezo element, and may be a thermal method of ejecting the ink using air bubbles which are produced in the nozzles by a heat generation element.

The maintenance unit 50 is used for performing the cleaning of the head 41, and includes a main wiper 51, a plurality of caps 52, a first supporting member 53, a storage box 54, a cleaning liquid supply pipe 55, a side wiper 56, a bottom surface wiper 57, a second supporting member 58, and a shielding plate 59. The maintenance unit 50 is positioned at a rear side in the Y-direction rather than the platen 42 (printing area), and when cleaning, the head 41 moves to the rear side in the Y-direction. In addition, a configuration of the maintenance unit 50 illustrated in FIG. 2 is provided in each head 41, and the configuration or the method of cleaning the head 41 is the same regardless of the ink color, and thus hereinafter the description becomes common.

The main wiper 51 and the caps 52, as illustrated in FIG. 3A, are supported by the first supporting member 53, and are able to move to both sides in the X-direction (transport direction of the continuous paper S) due to the first supporting member 53. The main wiper 51 is a plate shaped member erected from the first supporting member 53, and is formed by an elastic member, fabric, felt, or the like. In addition, the length of the main wiper 51 in the Y-direction is equal to or longer than the length of the head 41 in the Y-direction. The cap 52 is a member of an approximately rectangular shape formed by an elastic member such as gum, and is provided for each short head 44. In accordance with an arrangement of the short heads 44(1) to 44(4) in the head 41, four caps 52(1) to 52(4) are also lined up in the Y-direction. Thus, if the head 41 moves to the rear side in the Y-direction, the short heads 44 and the caps 52 face each other, and if the head 41 moves down, the caps 52 are in close contact with the nozzle opening surfaces of each short head 44 thereby sealing the nozzles Nz.

The storage box 54 stores the main wiper 51, the caps 52, and the first supporting member 53, and receives the ink exhausted during cleaning. As illustrated in FIG. 3A, the storage box 54 includes a bottom surface portion 54*a*, an eave portion 54*b*, and a side wall portion 54*c* which connects end portions on one side in the X-direction of the bottom surface portion 54*a* and the eave portion 54*b* with each other. In addition, although not illustrated, a pair of side wall portions which are opposing in the Y-direction extending downwardly from the eave portion 54*b* to the bottom surface portion 54*a* may also be provided in the storage box 54. Since the eave portion 54*b* is shorter in length in the X-direction than the bottom surface portion 54*a*, in an area of the other side in the X-direction of the storage box 54, the head 41 moves down more than the eave portion 54*b* and can be in contact with the main wiper 51 or the caps 52. In addition, in the bottom surface portion 54*a* of the storage box 54, an outlet 54*d* for exhausting the ink exhausted during cleaning to a waste liquid tank (not illustrated) is provided.

The cleaning liquid supply pipe 55 ejects cleaning liquid, and is provided in end portion on the other side in the X-direction of the eave portion 54*b* included in the storage box 54. A length of the cleaning liquid supply pipe 55 in the Y-direction is equal to or longer than the length of the head 41 in the Y-direction, and in the cleaning liquid supply pipe 55, a plurality of ejection holes 55*a* through which the cleaning liquid is exhausted are provided at an interval in the Y-direction. Thus, it is possible to uniformly eject the cleaning liquid to the side surface of the one side in the X-direction of the head 41 in the Y-direction. In addition, it is preferable that a solvent in which the ink (UV ink in the present embodiment) used in the printer 1 dissolves be used as the cleaning liquid, and for example, diethylene glycol monoethyl ether acetate (EDGAC), colorless transparent UV ink, or the like may be used.

The side wiper 56 and the bottom surface wiper 57 are supported by the second supporting member 58 positioned between the storage box 54 and the platen 42, and are movable in a vertical direction due to the second supporting member 58. The side wiper 56 is a member of an approximately rectangular shape formed by plastic or the like, and as illustrated in FIG. 3B, is positioned at the other side in the X-direction with respect to the head 41 which moves in the Y-direction, and is arranged with a predetermined gap A in the X-direction from the side surface 41*b* of the other side in the X-direction of the head 41. In addition, as illustrated in FIG. 3C, in the side surface of the one side in the X-direction of the side wiper 56, that is, in a side surface of a side opposing the head 41, a plurality of groove portions 56*a* with widths narrow enough to produce capillary forces are formed. The groove portion 56*a* extends in the vertical direction (gravity direction) from an upper end to a lower end of the side wiper 56. The bottom surface wiper 57 is a plate shaped member formed by an elastic member, fabric, felt or the like, and as illustrated in FIG. 3B, is arranged at a position such that the bottom surface wiper 57 can be in contact with an end portion of the other side in the X-direction in the nozzle opening surface 41*a* of the head 41. In addition, in a bottom portion of the second supporting member 58, an outlet 58*a* for exhausting the ink exhausted during cleaning to the waste liquid tank (not illustrated) is provided.

The shielding plate 59 suppresses the ultraviolet rays (leakage light) from the irradiation unit 43 from entering the maintenance area. Thus, the shielding plate 59, as illustrated in FIG. 2, is provided between the platen 42 and the second supporting member 58, that is, in a boundary portion between the printing area and the maintenance area.

The winding unit 60 includes a relay roller 61 which winds and feeds the continuous paper S fed from the downstream transport roller pair 34, and a winding driving shaft 62 which winds the continuous paper S fed from the relay roller 61. According to rotational driving of the winding driving shaft 62, the continuous paper S on which printing has been performed is sequentially wound in a roll shape.

Method of Cleaning Head 41

Figure 4:
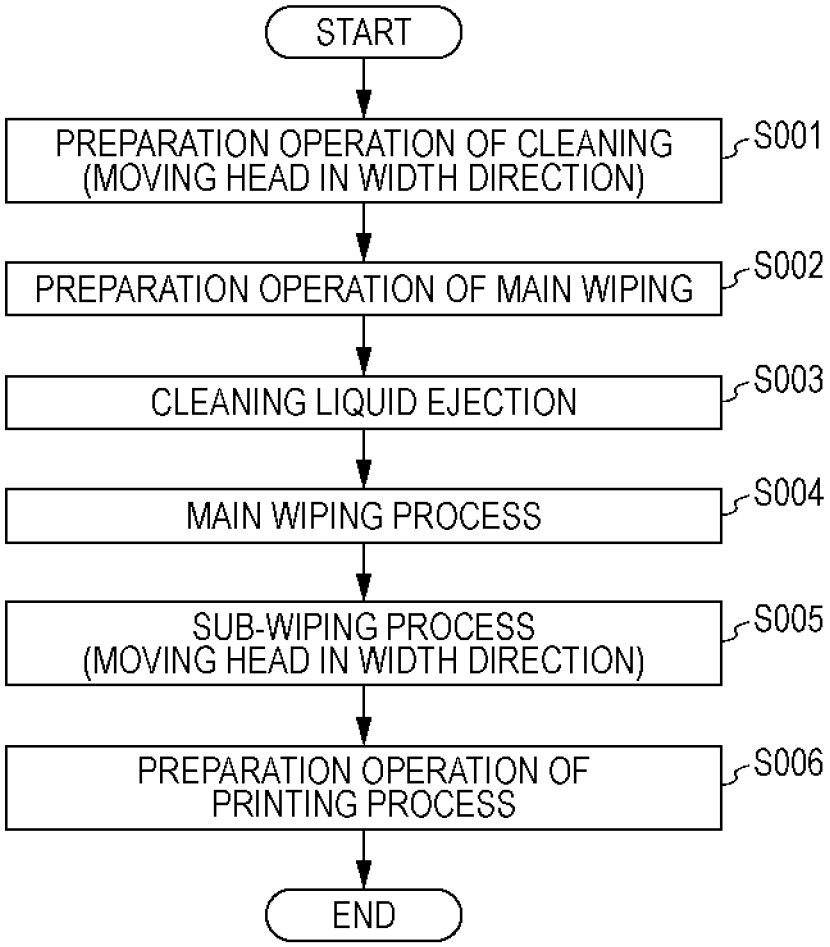
FIG. 4 is a flow chart of a method of cleaning a head.
Figure 5A:
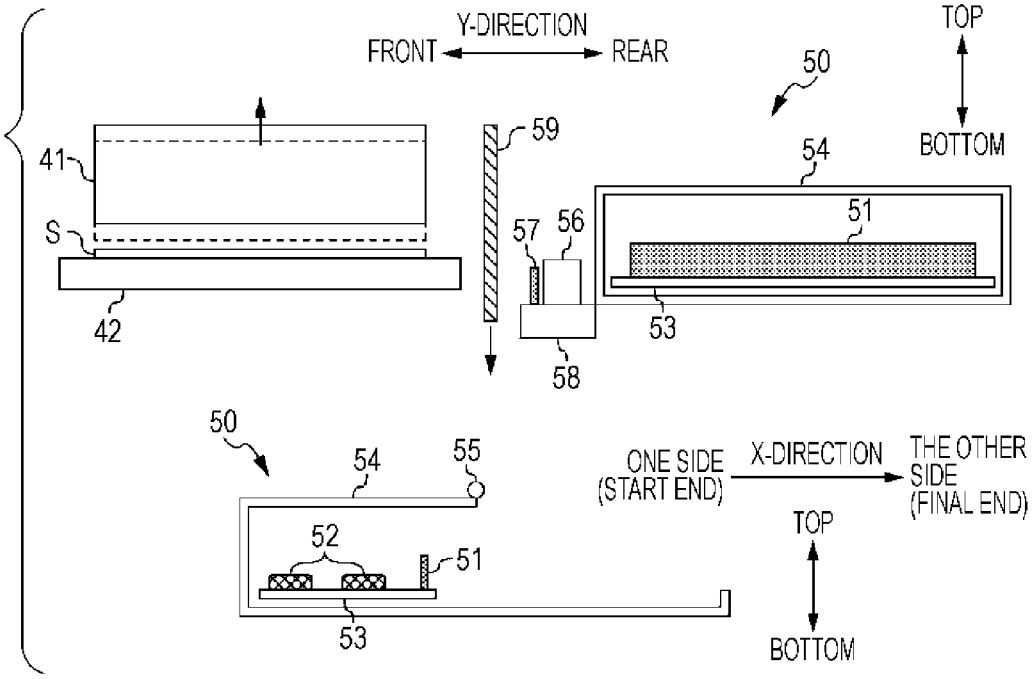
FIG. 5A is a view for explaining the method of cleaning a head.
Figure 5B:
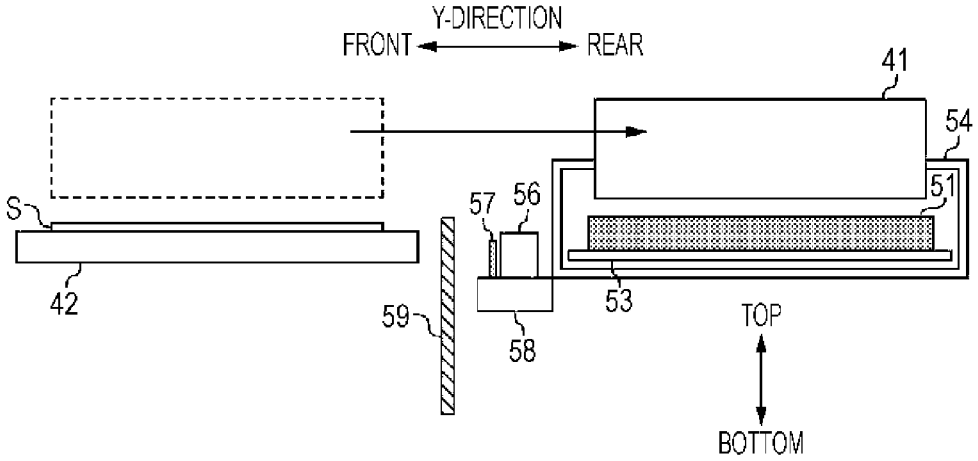
FIG. 5B is a view for explaining the method of cleaning a head.
Figure 5C:
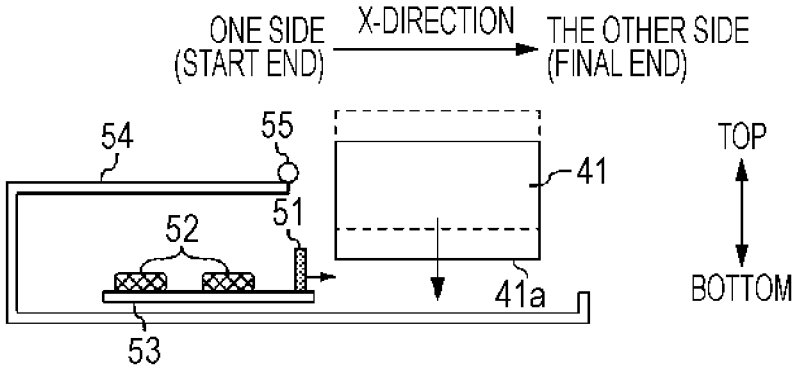
FIG. 5C is a view for explaining the method of cleaning a head.
Figure 5D:
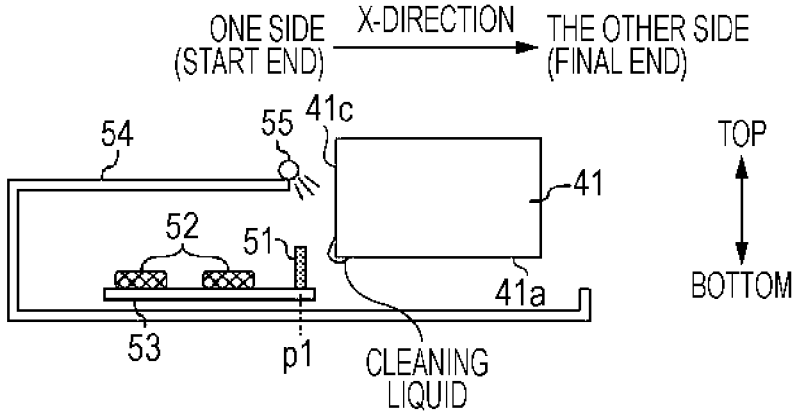
FIG. 5D is a view for explaining the method of cleaning a head.
Figure 5E:
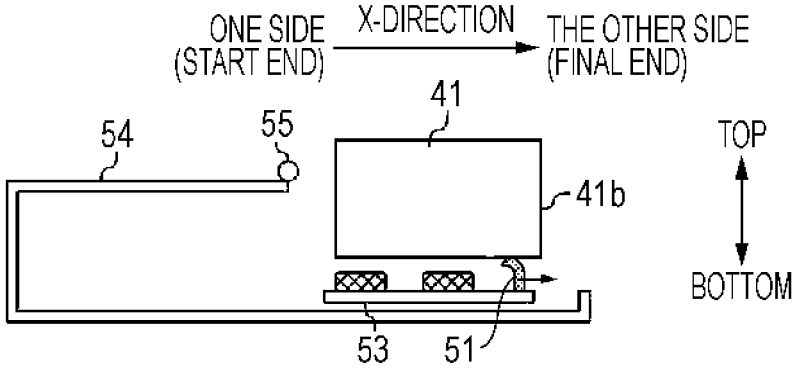
FIG. 5E is a view for explaining the method of cleaning a head.
Figure 5F:
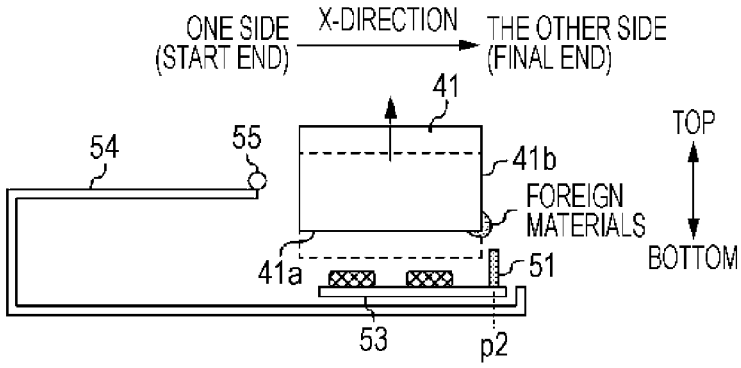
FIG. 5F is a view for explaining the method of cleaning a head.
Figure 5G:
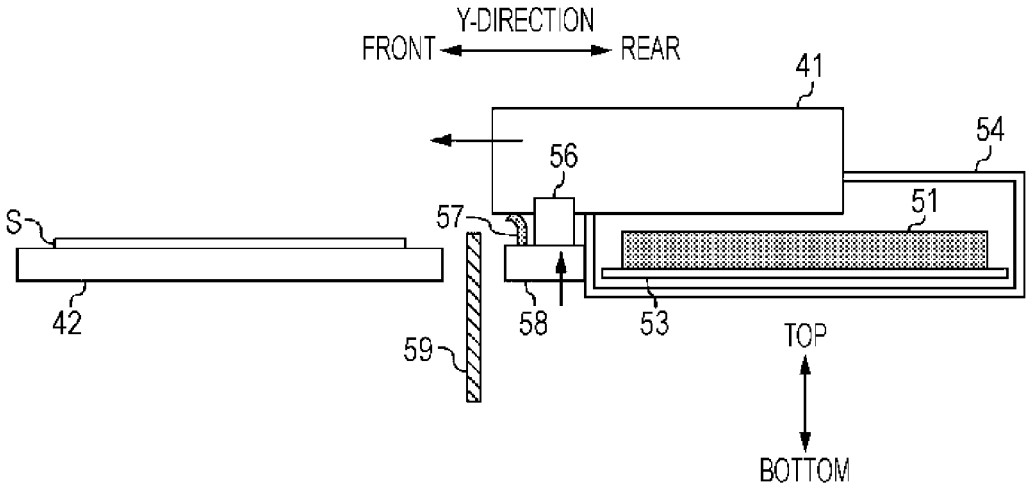
FIG. 5G is a view for explaining the method of cleaning a head.
Figure 6:
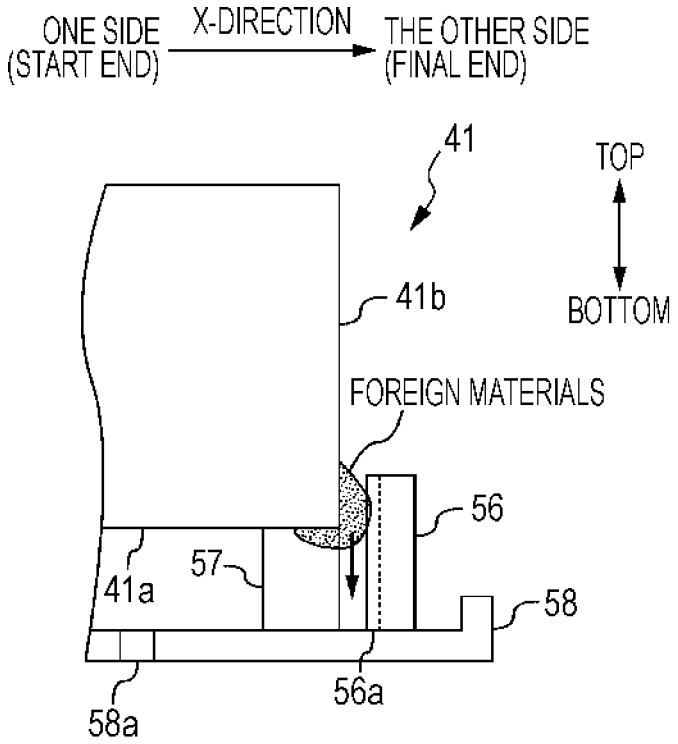
FIG. 6 is a view illustrating a state of removing ink from a corner portion of the head.

FIG. 4 is a flow chart of a method of cleaning the head 41, FIGS. 5A to 5G are views for explaining the method of cleaning the head 41, and FIG. 6 is a view illustrating a state of removing the ink from a corner portion of the head 41. When the ink is ejected from the nozzles Nz provided in the head 41, minute ink droplets are produced together with main ink droplets, and the minute ink droplets fly as mist, and adhere to the nozzle opening surface of the head 41. In addition, not only the ink but also dust or paper dust adheres to the nozzle opening surface of the head 41. If such foreign materials adhered to the nozzle opening surface of the head 41 are left and accumulated, the nozzles Nz become closed, and the ink ejection from the nozzle Nz is blocked. For example, a specified amount of ink is not ejected from the nozzles Nz, or a flight direction of the ink ejected from the nozzles Nz is shifted. As a result, an image quality of the printed image is degraded. Accordingly, the printer 1 according to the present embodiment performs a regular cleaning process for the head 41. Hereinafter, the method of cleaning the head 41 will be described.

FIG. 5A is a view illustrating a state of performing a printing process of an image on the continuous paper S. A top view of FIG. 5A is a view of the head 41, the maintenance unit 50 or the like, when viewed from the X-direction, and a bottom view of FIG. 5A is a view of the maintenance unit 50 when viewed from the Y-direction. During the printing process, the head 41 is arranged at a position opposing the continuous paper S on the platen 42. On the other hand, the main wiper 51, the caps 52, and the first supporting member 53 (hereinafter, collectively referred to as "main maintenance portions") are included within the storage box 54. In detail, the main maintenance portions 51 to 53 are arranged at a position (retreat position) covered by the eave portion 54*b* of the storage box 54. The side wiper 56, the bottom surface wiper 57 and the second supporting member 58 (hereinafter, collectively referred to as "sub-maintenance portions") are arranged at a position (retreat position) relatively lower with respect to the storage box 54. The shielding plate 59 is arranged at a raised position in such a manner that the maintenance unit 50 is not exposed when viewed from the printing area in the Y-direction.

In this way, the shielding plate 59 is provided in the boundary portion between the printing area and the maintenance area, and thereby it is possible to suppress the ultraviolet rays (leakage light) irradiated from the irradiation unit 43 from entering the maintenance area, during the printing process. In addition, the main maintenance portions 51 to 53 are stored within the storage box 54, and the sub-maintenance portions 56 to 58 are retreated downwardly, and thereby it is difficult for the ultraviolet rays from the irradiation unit 43 to reach the main maintenance portions 51 to 53 or the sub-maintenance portions 56 to 58. Thus, it is possible to suppress the UV ink adhered to the main maintenance portions 51 to 53 or the sub-maintenance portions 56 to 58 from being cured, and to suppress the UV ink removal from becoming difficult.

In addition, in the present embodiment, a driving source which moves the main maintenance portions 51 to 53 in the X-direction, and another driving source which moves the sub-maintenance portions 56 to 58 in the vertical direction are shared, and movements of both driving sources are interlocked. Specifically, when the main maintenance portions 51 to 53 are stored within the storage box 54, the sub-maintenance portions 56 to 58 are arranged at the most lowered retreat position, and as the main maintenance portions 51 to 53 move to the other side in the X-direction and then come out of the storage box 54, the sub-maintenance portions 56 to 58 rise. However, without being limited to this, the movements of the main maintenance portions 51 to 53 and the sub-maintenance portions 56 to 58 may not be interlocked.

Then, if a predetermined time elapses from the previous cleaning process of the head 41, the controller 10 within the printer 1 temporarily stops the printing process or ends the printing process being performed, and then performs a preparation operation for the cleaning (S001). In addition, without being limited to performing the cleaning process at each of predetermined timings, for example, the cleaning process may be performed whenever the images are printed on the continuous paper S over a predetermined length, and the cleaning process may be performed by an instruction of a user. In addition, when a power supply of the printer 1 is switched on or the printer 1 resumes after the stop state, the cleaning process is performed.

As illustrated in FIGS. 5A and 5B, as the preparation operation for the cleaning, the controller 10 makes the head 41 ascend in a state where a distance (paper gap) from the platen 42 (continuous paper S) to the nozzle opening surface is set to a specified distance, and also, makes the shielding plate 59 descend in such a manner that the shielding plate 59 is not in contact with the head 41, and thereafter moves the head 41 to the rear side in the Y-direction. The head 41 moves to the rear side in the Y-direction until its position in the Y-direction becomes the same as the main wiper 51. At this time, since the main maintenance portions 51 to 53 are stored within the storage box 54 and the sub-maintenance portions 56 to 58 are descended, the side wiper 56 or the bottom surface wiper 57 is not in contact with the head 41 which moves in the Y-direction.

Next, the controller 10 performs the preparation operation for the main wiping process performed by the main wiper 51 (S002). Specifically, as illustrated in FIG. 5C, the controller 10 makes the head 41 descend with respect to the main wiper 51, and moves the main wiper 51 (main maintenance portions 51 to 53) to the other side in the X-direction from the retreat position to a wiping start position, in such a manner that a front end portion of the main wiper 51 is in contact with the nozzle opening surface 41*a* of the head 41. The wiping start position is a position where the main wiper 51 is arranged further to the one side in the X-direction more than the head 41. Thus, in a main wiping process (FIG. 5E) of the next stage, the main wiper 51 moves to the other side (final end side) from the one side (start end side) in the X-direction with respect to the head 41.

Next, as illustrated in FIG. 5D, the controller 10 ejects the cleaning liquid toward a side surface 41*c* of the one side in the X-direction of the head 41, from the cleaning liquid supply pipe 55 (S003). That is, the cleaning liquid is ejected to the side surface 41*c* of the head 41 at the start end side in the moving direction of the main wiper 51. The cleaning liquid adhered to the side surface 41*c* of the head 41 flows downwardly along the side surface 41*c*, and is in a state of remaining on the corner portion formed by the side surface 41*c* and the nozzle opening surface 41*a* of the head 41.

Next, the controller 10 performs the main wiping process (S004). Specifically, as illustrated in FIG. 5E, the controller 10 moves the main wiper 51 (main maintenance portions 51 to 53) to the other side from the one side in the X-direction with respect to the head 41. At this time, the main wiper 51 first contacts the corner portion of the head 41 to which the cleaning liquid adheres. For this reason, the main wiper 51 in a state of being wet with the cleaning liquid, moves in the X-direction, contacting the nozzle opening surface of the head 41, and gathers up the foreign materials such as the ink adhered to the nozzle opening surface. In this way, the main wiper 51 in a state of being wet with the cleaning liquid performs the wiping process, and thereby it is possible to perform the wiping process, dissolving the ink thickened or cured on the nozzle opening surface of the head 41 by the leakage light or a long adhesion. Thus, it is possible to make the nozzle opening surface of the head 41 cleaner, as compared to when the wiping process is performed without using the cleaning liquid. However, without being limited to this, the main wiping process may be performed without the cleaning liquid being used.

Then, the main wiper 51 moves to the position of the other side in the X-direction further than the side surface 41*b* of the other side in the X-direction of the head 41, gathering up the foreign materials adhered to the nozzle opening surface of the head 41. As illustrated in FIG. 2, since the length of the main wiper 51 in the Y-direction is equal to or longer than the length of the head 41 in the Y-direction, the main wiper 51 moves one time in the X-direction with respect to the head 41, and thereby the main wiper 51 can contact all areas of the nozzle opening surface of the head 41. As a result, the foreign materials are wiped off the nozzle opening surface of the head 41 by the main wiper 51, and the nozzle opening surface can be cleaned.

However, when the main wiper 51 is separated from the head 41, the foreign materials gathered up by the main wiper 51, as illustrated in FIG. 5F, frequently adhere to a corner portion (in detail, corner portion formed by the side surface 41*b* of the other side in the X-direction of the head 41 and the nozzle opening surface 41*a*) of the head 41. In particular, in a case where, as in the main wiping process according to the present embodiment, the main wiper 51 moves to a position departing from the side surface 41*b* of the head 41, the foreign materials frequently adhere to the side surface 41*b* of the head 41. In this way, if the foreign materials adhered to the corner portion of the head 41 are left and accumulated, when the head 41 returns to the printing area, the continuous paper S or the platen 42 is contaminated by the foreign materials on the corner portion of the head 41.

Therefore, after performing the main wiping process, the printer 1 according to the present embodiment performs a sub-wiping process using the side wiper 56 and the bottom surface wiper 57 (S005). For this reason, after making the head 41 ascend as illustrated in FIG. 5F, the controller 10 first moves the head 41 to a front side (printing area side) in the Y-direction as illustrated in FIG. 5G. At this time, since the main maintenance portions 51 to 53 come out of the storage box 54, the sub-maintenance portions 56 to 58 are arranged at a position (wiping position) ascended to from the retreat position. In detail, as illustrated in FIG. 3B, the side wiper 56 is arranged at a position where a front end portion thereof can oppose the side surface 41*b* of the other side in the X-direction of the head 41, and the bottom surface wiper 57 is arranged at a position where a front end portion thereof can contact an end portion of the other side in the X-direction in the nozzle opening surface 41*a* of the head 41.

For this reason, when the head 41 moves to the front side in the Y-direction, the side wiper 56, as illustrated in FIG. 6, does not contact the side surface 41*b* of the other side in the X-direction of the head 41, but contacts the foreign materials adhered to the side surface 41*b*. As described above (FIG. 3C), in the side surface of the side wiper 56 at a position opposing the head 41, the groove portion 56*a* producing the capillary force is formed so as to extend in the vertical direction. Thus, if the side wiper 56 contacts the foreign materials adhered to the side surface 41*b* of the head 41, the foreign materials are led to the groove portion 56*a* by the capillary force of the groove portion 56*a* of the side wiper 56, and flows to the bottom surface of the second supporting member 58 which supports the side wiper 56. As a result, it is possible to remove the foreign materials adhered to the side surface 41*b* of the head 41, from the head 41. In addition, the foreign materials adhered to the nozzle opening surface 41*a* being integrated with the foreign materials adhered to the side surface 41*b* of the head 41, can also flow into the groove portion 56*a* of the side wiper 56. That is, the foreign materials adhered to the corner portions of the head 41 can be removed by the side wiper 56. In addition, the ink flowing to the bottom surface of the second supporting member 58 is exhausted to the waste liquid tank (not illustrated) from the outlet 58*a* provided in the bottom surface of the second supporting member 58.

Further, as illustrated in FIG. 6, in a state where the bottom surface wiper 57 is in contact with the end portion of the other side in the X-direction in the nozzle opening surface 41*a* of the head 41, the head 41 moves in the Y-direction with respect to the bottom surface wiper 57. Thus, the foreign materials which are gathered up by the main wiper 51 and adhered to the nozzle opening surface 41*a* of the head 41 are also removed by the bottom surface wiper 57. In this way, when the head 41 returns to the printing area, it is possible to wipe off the foreign materials adhered to the corner portions of the head 41 using the side wiper 56 and the bottom surface wiper 57. Thus, it is possible to suppress the continuous paper S or the platen 42 from being contaminated by the foreign materials adhered to the head 41.

Finally, the controller 10 performs the preparation operation for the printing process (S006). Specifically, as illustrated in FIG. 5A, the controller 10 stores the main maintenance portions 51 to 53 in the storage box 54, makes the sub-maintenance portions 56 to 58 descend to the retreat position, and makes the shielding plate 59 ascend, and makes the head 41 descend in such a manner that the paper gap becomes the specified distance. By the above processes, the cleaning process of the head 41 is completed. In addition, in a case where there is no next printing job after the cleaning process, by returning the head 41 to the maintenance area, the short head 44 may be sealed by the cap 52. In addition, for example, in addition to the wiping process, the ink may be circulated at a high speed between a tank storing the ink and the head 41 and thereby the foreign materials within the head 41 may be sent to the tank, or the ink within the head 41 may be pressurized and thereby a normal ink from a nozzle and the foreign materials may be exhausted.

As described above, in the cleaning process of the head 41 according to the present embodiment, the main wiper 51 (corresponds to a first wiping member), in a state of being in contact with the nozzle opening surface 41*a* of the head 41, moves to the other side from the one side in the X-direction (corresponds to a predetermined direction) with respect to the head 41, and thereby the main wiping process (corresponds to a first wiping process) of wiping off the foreign materials adhered to the nozzle opening surface 41*a* of the head 41 is performed, and thereafter, a sub-wiping process (corresponds to a second wiping process) in which the side wiper 56 (corresponds to a second wiping member) removes the foreign materials adhered to the side surface 41*b* of the other side in the X-direction of the head 41, is performed. By doing this, the foreign materials can be removed from the nozzle opening surface 41*a* of the head 41 by the main wiper 51, and the nozzle opening surface 41*a* of the head 41 can be cleaned. In addition, although the foreign materials gathered up by the main wiper 51 adhere to the side surface 41*b* or the nozzle opening surface 41*a* of the head 41 of the final end side (the other side) in a moving direction of the main wiper 51, the foreign materials can be removed by the side wiper 56. Thus, it is possible to suppress the continuous paper S or the platen 42 from being contaminated by the foreign materials adhered to the head 41.

In addition, the nozzle opening surface 41*a* of the head 41 opposes the continuous paper S, and in general, the paper gap is set to be narrow. Therefore, it is preferable that the foreign materials be wiped off more reliably from, in particular, the nozzle opening surface 41*a* of the head 41. Accordingly, in the present embodiment, at the time of the sub-wiping process, in a state where the bottom surface wiper 57 (corresponds to a third wiping member) is in contact with the end portion of the other side in the X-direction in the nozzle opening surface 41*a* of the head 41, the head 41 is moved in the Y-direction with respect to the bottom surface wiper 57. For this reason, the foreign materials which are gathered up by the main wiper 51 and adhered to the nozzle opening surface 41*a* of the head 41 can be wiped off more reliably. That is, since the foreign materials adhered to the nozzle opening surface 41*a* of the head 41 are wiped off in two crossing directions by the main wiper 51 and the bottom surface wiper 57, the nozzle opening surface 41*a* of the head 41 can be made cleaner. However, without being limited to this, there may be a configuration without the bottom surface wiper 57. In addition, as illustrated in FIG. 3B, the bottom surface wiper 57 is in contact with a portion in which the short head 44 is not arranged in the nozzle opening surface 41*a* of the head 41 (in contact with a portion in which a nozzle opening portion is not positioned). Thus, when the bottom surface wiper 57 wipes off the foreign materials gathered up by the main wiper 51, it is possible to prevent the foreign materials from entering into the nozzle.

In addition, at the time of the sub-wiping process, the side wiper 56 does not contact the side surface 41*b* of the other side in the X-direction of the head 41, and is arranged at the position for contacting the foreign materials adhered to the side surface 41*b*. For this reason, it is possible to remove the foreign materials adhered to the side surface 41*b* of the head 41 and improve durability of the side wiper 56. In other words, since there is no possibility that the side surface 41*b* of the head 41 is damaged by the side wiper 56, it is possible to form the side wiper 56 using a member such as plastic having higher rigidity than the main wiper 51. Also from this view point, it is possible to improve the durability of the side wiper 56. Thus, it is also possible to suppress a problem of time, labor, or cost being incurred by an exchange of the side wiper 56. In addition, in a case where the side wiper 56 is arranged so as to directly contact the side surface 41*b* of the other side in the X-direction of the head 41, there is a possibility that the wiped off foreign materials may be scattered, during the wiping of the side surface 41*b*, particularly at the end of the wiping. Accordingly, in order to suppress the scattering, it is necessary to decrease the moving speed at an end stage of the wiping, and to devise the wiper in such a manner that it does not start suddenly. In contrast, at the time of the sub-wiping process, if the side wiper 56 does not contact the side surface 41*b* of the other side in the X-direction of the head 41 and is arranged at a position for contacting the foreign materials adhered to the side surface 41*b*, although the side wiper 56 and the head 41 perform a relative movement at a constant speed, it is possible to reduce the scattering of the foreign materials. In addition, although some ink adheres to the side surface of the head 41, the continuous paper S or the platen 42 has a low probability of being contaminated. Accordingly, based on an acceptable amount of the ink adhered to the side surface of the head 41, a gap (gap A in FIG. 3B) between the side surface 41*b* of the head 41 and the side wiper 56 may be determined.

In addition, on a side surface opposing the head 41 in the surfaces of the side wiper 56, a groove portion 56*a* which leads the foreign materials adhered to the side surface of the head 41 to the second supporting member 58 (corresponds to exhausting portion) are provided. For this reason, as in the present embodiment, although the side wiper 56 does not directly contact the side surface 41*b* of the head 41, it is possible to more reliably remove the foreign materials (ink) adhered to the side surface 41*b* of the head 41, using the capillary force of the groove portion 56*a* of the side wiper 56. Further, in the present embodiment, the groove portion 56*a* of the side wiper 56 extends in the vertical direction (gravity direction), and the foreign materials are led to the second supporting member 58 positioned lower than the head 41 in the vertical direction. Thus, it is also possible to remove the foreign materials from the head 41 by own weight of the foreign materials in addition to the capillary force of the groove portion 56*a*, and to more reliably remove the foreign materials from the head 41. However, without being limited to this, even for the side wiper which does not produce the capillary force with the groove portion, it is possible to wipe off the foreign materials from the side surface of the head 41 by contacting the foreign materials adhered to the side surface of the head 41.

In addition, at the time of the sub-wiping process, the head 41 moves in the Y-direction (direction crossing a predetermined direction) with respect to the side wiper 56. For this reason, it is possible to remove the foreign materials using the side wiper 56 over the whole area in the Y-direction of the side surface 41*b* of the head 41. In other words, since the length of the side wiper 56 in the Y-direction, as the main wiper 51, is not required to be equal to or longer than the length of the side surface 41*b* of the head 41 in the Y-direction, miniaturization or cost reduction of an apparatus is achieved. In addition, in the present embodiment, when the head 41 returns to the printing area from the maintenance area, the sub-wiping process is performed. For this reason, it is possible to reduce the cleaning time of the head 41, as compared to when the return operation of the head 41 or the sub-wiping process is separately performed.

Modification Example

Figure 7A:
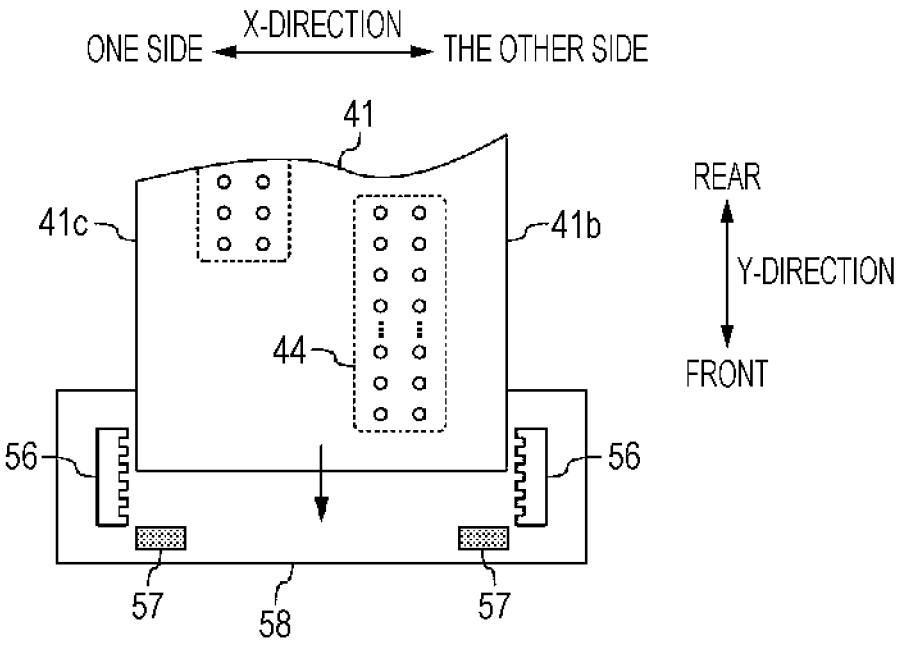
FIG. 7A is a view illustrating a modification example of a sub-maintenance portion.

FIG. 7A is a view illustrating a modification example of the sub-maintenance portions 56 to 58. In the above-described embodiment, the main wiper 51 moves only one time from the one side to the other side in the X-direction, but without being limited to this, the main wiper 51 may perform a reciprocating movement one time or multiple times. In this case, it is possible for the foreign materials gathered up by the main wiper 51 to adhere not only to the corner portion of the other side in the X-direction of the head 41, but also to the corner portion of the head 41 of the one side in the X-direction. Accordingly, as illustrated in FIG. 7A, a pair of side wipers 56 which remove the foreign materials adhered to both side surfaces 41*b* and 41*c* in the X-direction of the head 41, and a pair of bottom surface wipers 57 which are in contact with both end portions in the X-direction in the nozzle opening surface 41*a* of the head 41, may be provided in the second supporting member 58.

In addition, when the reciprocating movement of the main wiper 51 is performed, a wiping end point of first half of the reciprocating movement may be set on the nozzle opening surface 41*a* of the head 41, and the main wiper 51 may be set so as not to depart from the head 41. By doing so, it is possible to reduce the wiping process time, and at the first half of the reciprocating movement, it is difficult for the foreign materials to adhere to the side surface of the head 41 at a side to which the main wiper 51 moves. Accordingly, although the side wiper 56 and the bottom surface wiper 57 are arranged at the side to which the main wiper 51 moves at the second half of the reciprocating movement, but only the bottom surface wiper 57 may be arranged at the side to which the main wiper moves at the first half of the reciprocating movement. In addition, a wiping start point of the first half of the reciprocating movement may be set as a point which is shifted to a side to which the main wiper 51 moves at the time of the second half of the reciprocating movement, rather than the wiping end point of the first half of the reciprocating movement, in such a manner that the foreign materials gathered up by the main wiper 51 at the time of the first half of the reciprocating movement do not adhere to the main wiper 51 at the time of the second half of the reciprocating movement.

In addition, in the above-described embodiment (FIG. 1B), the platen 42 with a flat surface supporting the continuous paper S is used, but without being limited to this, for example, a printer in which a rotation drum rotating with the width direction (Y direction) of the continuous paper S as a rotation axis is used as a platen and which winds the continuous paper S in the rotation drum and transports the wound continuous paper and ejects the ink from the head 41, may be used. In this case, the head 41 is arranged so as to be inclined along an outer peripheral surface of an arc shape of the rotation drum. In this case, since the cleaning liquid frequently remain on the corner portion of a side (lower side) where the head 41 is inclined, it is preferable that the main wiper 51 be moved to an opposite side with respect to the side (lower side) where the head 41 is inclined from the side where the head 41 is inclined. According to this, the side wiper 56 may be provided at only the opposite side with respect to the side where the head 41 is inclined.

Figure 7B:
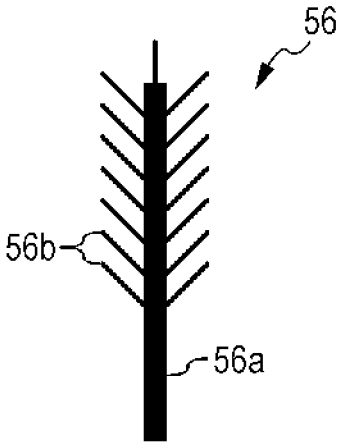
FIG. 7B is a view illustrating a modification example of the side wiper.

FIG. 7B is a view illustrating a modification example of the side wiper 56. Any one that can remove the foreign materials adhered to the side surface 41*b* of the head 41 may be used as the side wiper, and for example, as illustrated in FIG. 7B, a brush-shaped member with many brush bristles 56*b* projecting out from a shaft portion 56*a* may be used as the side wiper 56. In this case, the foreign materials (ink) adhered to the head 41 may be led between the brush bristles 56*b* by the capillary force between the brush bristles 56*b*, and thereafter, the foreign materials may flow to the second supporting member 58 along the shaft portion 56*a*.

In addition, in the above-described embodiment, the side wiper 56 does not contact the side surface of the head 41, however, without being limited to this, the side wiper 56 may contact the side surface of the head 41. In addition, in the above-described embodiment, the head 41 is moved in the Y-direction with respect to the side wiper 56, but the invention is not limited to this. For example, the length of the side wiper 56 in the Y-direction may be made equal to or longer than the length of the head 41 in the Y-direction, and the side wiper 56 may be moved in the vertical direction (direction crossing the nozzle opening surface), and thereby the side wiper 56 may directly contact the side surface of the head 41 or contact the side surface of the head 41 via the foreign materials, and the foreign materials adhered to the side surface of the head 41 may be removed. In addition, in the above-described embodiment, the main wiper 51 is moved with respect to the head 41, but without being limited to this, the head 41 may be moved with respect to the main wiper 51, and both the head 41 and the main wiper 51 may be moved. Similarly, in the above-described embodiment, the head 41 is moved with respect to the side wiper 56 and the bottom surface wiper 57, but without being limited to this, the side wiper 56 and the bottom surface wiper 57 may be moved with respect to the head 41, and the three members 41, 56 and 57 may be moved.

In addition, in the above-described embodiment, at the time of starting the cleaning of the head 41, that is, before the main wiping process is performed (FIG. 5B), the side wiper 56 and the bottom surface wiper 57 are arranged at the retreat position so as not to contact the head 41, but without being limited to this, before the main wiping process is performed, the sub-wiping process may be performed, and the foreign materials adhered to the head 41 during the prior main wiping process may be wiped off. In addition, in this case, after the main wiping process, the sub-wiping process may not be performed.

Other Embodiment

As described above, the above-described embodiments are intended to facilitate the understanding of the present invention, and are not intended to be construed by limiting the present invention. The present invention can be modified and improved without departing from the spirit thereof, and equivalents thereof are also included in the present invention.

For example, in the above-described embodiments, a printer is exemplified which prints a two-dimensional image by ejecting the ink from the head, with respect to a recording medium being transported, without stopping, under the fixed head with the nozzles lined up over the recording medium with the distance between both end nozzles equal to or longer than the width of the recording medium, but the printer is not limited to this. For example, the printer may also repeat the operation of ejecting the ink by moving the head in the X-direction and printing the two-dimensional image by moving the head in the Y-direction with respect to the recording medium positioned at the printing area, and an operation of supplying a new portion of the recording medium to the printing area by transporting the recording medium in the X-direction. In addition, for example, the printer may also repeat an operation of ejecting the ink by moving the head in the direction (width direction of the recording medium) crossing the nozzle column direction, and a transport operation of transporting the medium in the nozzle column direction (a direction in which the medium is continuously formed in a case where the recording medium is a continuous medium). In addition, for example, the printer may also repeat an operation of ejecting the ink onto the recording medium moving in the X-direction with respect to the head, and an operation of moving the recording medium in the Y-direction with respect to the head.

In the above-described embodiment, as the liquid ejecting apparatus, the ink jet printer is exemplified, but the liquid ejecting apparatus is not limited to this. For example, the liquid ejecting apparatus may be a color filter manufacturing apparatus, a display manufacturing apparatus, a semiconductor manufacturing apparatus, a DNA chip manufacturing apparatus, or the like.

The entire disclosure of Japanese Patent Application No. 2013-071595, filed Mar. 29, 2013 is expressly incorporated by reference herein.

What is claimed is:

1. A liquid ejecting apparatus comprising:

a head in which a nozzle ejecting liquid onto a recording medium is provided;

a first wiping member which performs a first wiping process of wiping off foreign materials adhered to a nozzle opening surface of the head by moving a relative position thereof with respect to the head to the other side from one side in a predetermined direction, in a state of being in contact with the nozzle opening surface; and a second wiping member which performs a second wiping process of removing the foreign materials adhered to a side surface of the head at the other side in the predetermined direction, wherein the second wiping member is arranged at a position for contacting the foreign materials adhered to the side surface of the head without contacting the side surface, at the time of the second wiping process.

2. The liquid ejecting apparatus according to claim 1, wherein the second wiping member and the head perform a relative movement in a direction crossing the predetermined direction, at the time of the second wiping process.

3. The liquid ejecting apparatus according to claim 1, wherein a groove which leads the foreign materials adhered to the side surface of the head to an exhausting portion is provided in a surface of the second wiping member at a side opposing the head.

4. The liquid ejecting apparatus according to claim 1, wherein the second wiping member has a brush shape.

5. The liquid ejecting apparatus according to claim 1, further comprising:

a third wiping member which wipes off the foreign materials adhered to an end portion of the nozzle opening surface of the head at the other side in the predetermined direction by performing a relative movement to the head in a direction crossing the predetermined direction, in a state of being in contact with the end portion.

6. A method of cleaning a head in which a nozzle ejecting liquid onto a recording medium is provided, comprising:

performing a first wiping process of wiping off foreign materials adhered to a nozzle opening surface of the head by moving a relative position of a first wiping member with respect to the head to the other side from one side in a predetermined direction, with the first wiping member being in contact with the nozzle opening surface; and performing a second wiping process of removing the foreign materials adhered to a side surface of the head at the other side in the predetermined direction by a second wiping member, wherein the second wiping member is arranged at a position for contacting the foreign materials adhered to the side surface of the head without contacting the side surface, at the time of the second wiping process.

* * * * *